United States Patent [19]

Morral Gispert

[11] Patent Number: 5,050,250

[45] Date of Patent: Sep. 24, 1991

[54] COUNTERCURRENT INSTALLATION FOR SWIMMING POOLS

[75] Inventor: Jaime Morral Gispert, Santa Perpetua de Mogoda, Spain

[73] Assignee: Astral Sociedad Anonima de Construcciones Metalicas, Spain

[21] Appl. No.: 581,512

[22] Filed: Sep. 12, 1990

[30] Foreign Application Priority Data

Sep. 13, 1989 [ES] Spain ..... 8903573

[51] Int. Cl.[5] ..... E04H 3/18; A47K 3/10; A61H 9/00

[52] U.S. Cl. ..... 4/492; 4/509; 4/544

[58] Field of Search ..... 4/492, 488, 491, 541, 4/542, 543, 544, 507, 509, 496; 210/169; 239/282, 283

[56] References Cited

U.S. PATENT DOCUMENTS

| | | | |
|---|---|---|---|
| 3,605,131 | 9/1971 | R. Brazel et al. | 4/491 |
| 3,977,027 | 8/1976 | Speck | 4/491 |
| 4,193,143 | 3/1980 | De Carvalho Vianna | 4/496 |
| 4,275,713 | 6/1981 | Tellander et al. | 4/491 |
| 4,574,048 | 3/1986 | van den Broek | 210/169 |
| 4,606,819 | 8/1986 | Colson | 210/169 |
| 4,801,378 | 1/1989 | Desjoyaux et al. | 4/507 |
| 4,941,217 | 7/1990 | Tobias et al. | 4/492 |

FOREIGN PATENT DOCUMENTS

| | | | |
|---|---|---|---|
| 2358534 | 2/1978 | France . | |
| 2015005 | 8/1971 | Fed. Rep. of Germany . | |
| 2209507 | 9/1973 | Fed. Rep. of Germany | 4/491 |
| 2233528 | 10/1973 | Fed. Rep. of Germany | 4/507 |
| 2256128 | 5/1974 | Fed. Rep. of Germany | 4/488 |
| 2319902 | 11/1974 | Fed. Rep. of Germany | 4/492 |
| 2408270 | 8/1975 | Fed. Rep. of Germany | 4/492 |

*Primary Examiner*—William A. Cuchlinski, Jr.
*Assistant Examiner*—John L. Beres
*Attorney, Agent, or Firm*—Steinberg & Raskin

[57] ABSTRACT

This installation allows the drive pump (16) to be connected directly to the main housing (1) of the installation, or remotely from said housing; it is provided with a simplified structure and comprises the removable assembly of a closed handgrip (35), for the user, which is attached to a strong base plate (27) intermediate the front surface (14) of the main housing (1) and a light-weight face plate (34). The pump (16) is attached to a plate (5) which is attached directly to the rear surface of the main housing (1) and is provided with tubular stubs (8 and 9) for the coupling of the discharge tube (10), which is connected to the orifice (11) and of the suction tube (12). The said plate (5) may also be attached by pipelines (21 and 22) to another smaller plate (18) which is then attached to the main housing (1), and which is also provided with tubular stubs (19 and 20).

4 Claims, 3 Drawing Sheets

COUNTERCURRENT INSTALLATION FOR SWIMMING POOLS

Figure 1:
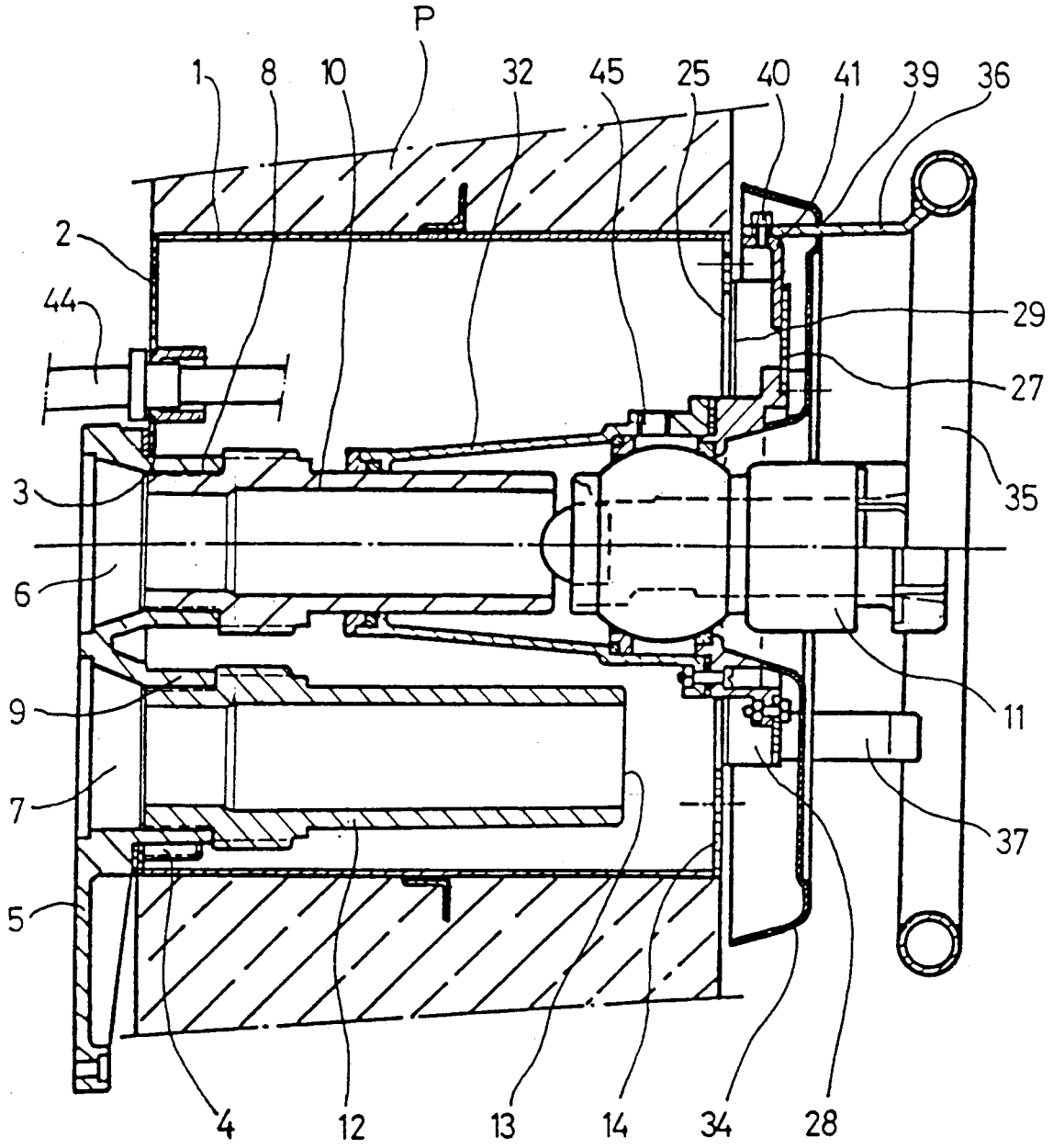

The present invention relates to a counterurrent installation for swimming pools.

This type of installation is already known and the purpose thereof is to produce a jet of water of adjustable force, with the possibility of bubbling with the controlled addition of air. Such installations are mounted in the wall of the swimming pool and allow the user to swim against the current and massage his body.

These installations comprise a main housing having a face plate with controls, with an orifice for discharging the water mixed with air and with a handgrip, the suction and discharge of the water being effected by means connected to a pump. Examples of these facilities are described in German patent DE 2 408 270 and U.S. Pat. No. 3 977 027.

Although the known installations are functionally acceptable, they suffer from certain drawbacks, such as the arrangement of a handgrip which does not provide security for the user and the complexity of the structure and assembly of the various component parts of the installation.

To overcome these problems, the installation of the invention is provided characteristically with a set of two plates for selective mounting of the pump in the main housing of the installation which plates are provided on the front with two tubular stubs for respective coupling of the tube to be connected to the water discharge orifice and the tube for suction of water from the swimming pool.

The larger of these two plates is used for direct coupling of the pump to the main housing to obtain a compact unit or for the indirect coupling of the pump through the pertinent pipes which will be coupled through the front ports thereof to the other smaller plate attached to the main housing.

A further feature of this installation is the fact that the face plate is formed by a plate attached to a front base plate inserted between the face plate and the front surface of the main housing to which said base plate is attached. To the front base plate is attached a closed handgrip forming a ring around the face plate, where the person using the installation may hold on in any position and without any risk of becoming hooked on the handle as may happen with those having an open form.

These and other features will be better understood from the following detailed description, to facilitate which there are provided three sheets of drawings in which one practical embodiment has been shown cited only as a non-limiting example of the scope of the present invention.

Figure 2:
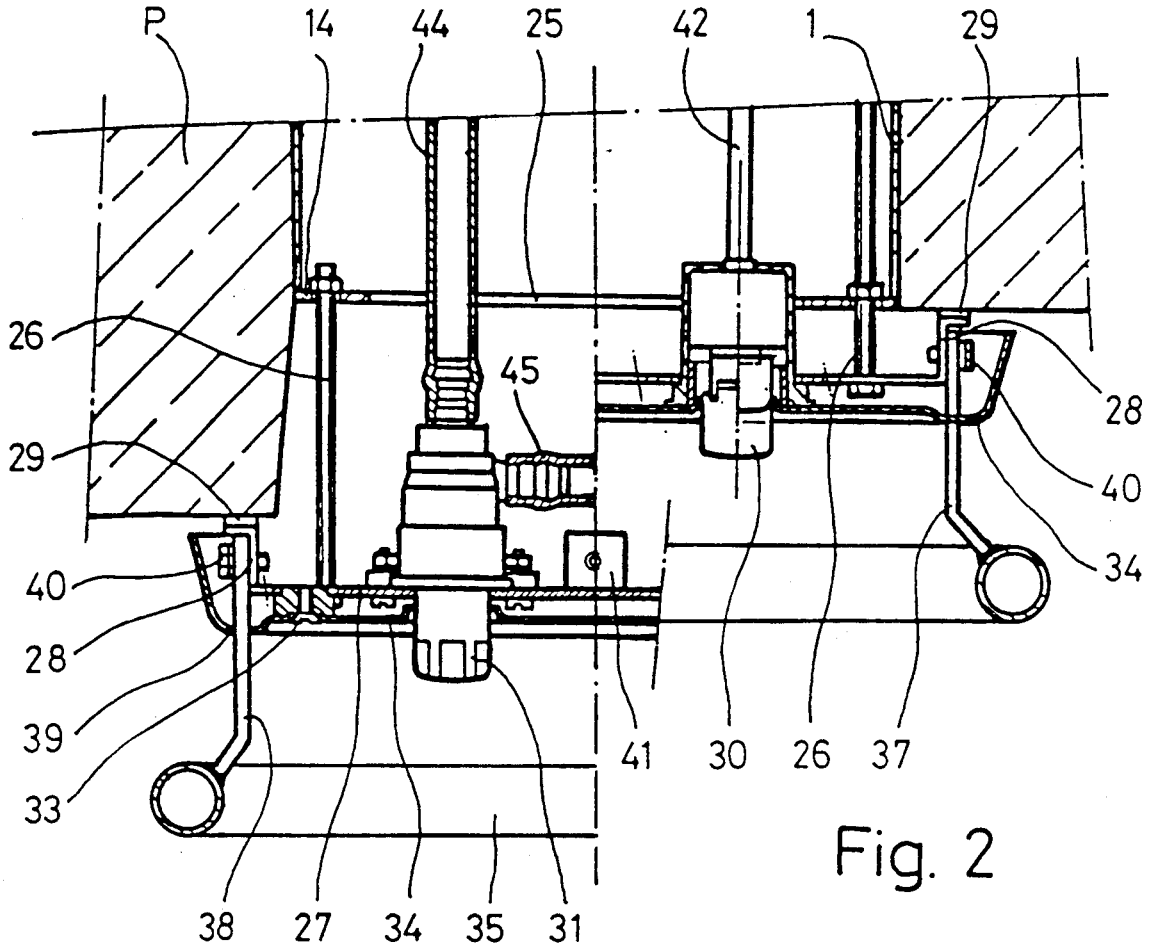
Figure 3:
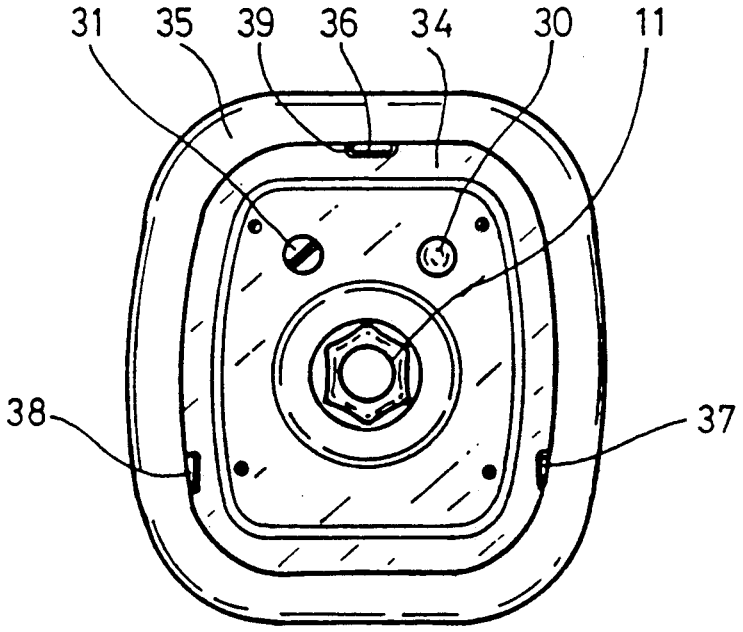
Figure 4:
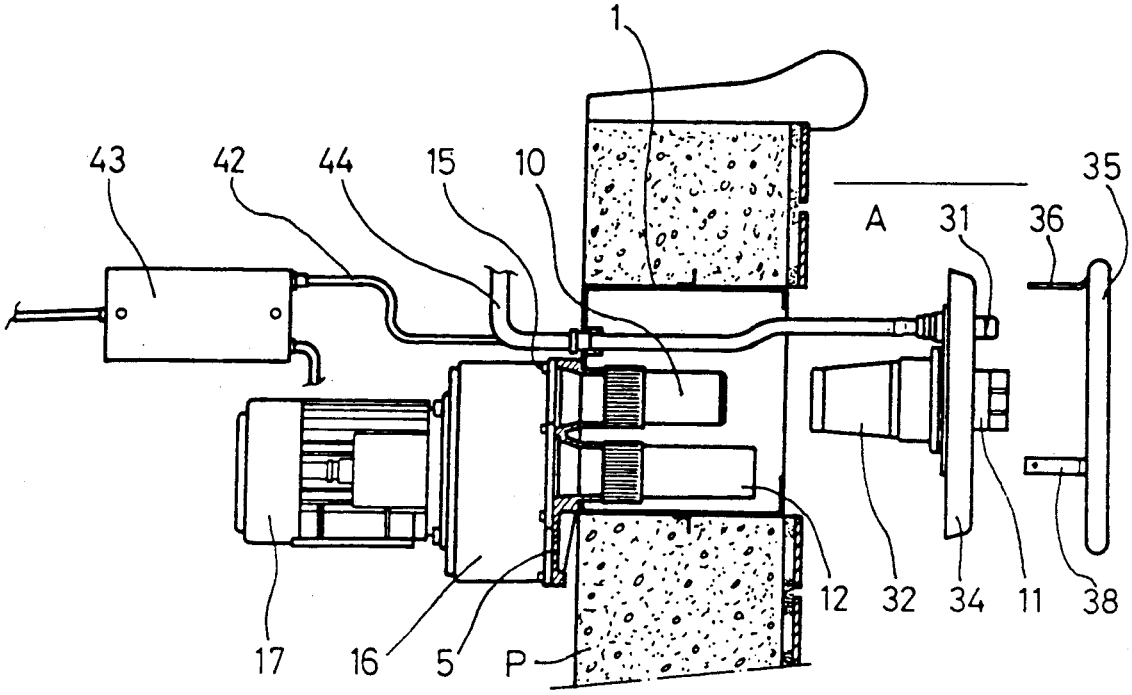
Figure 5:
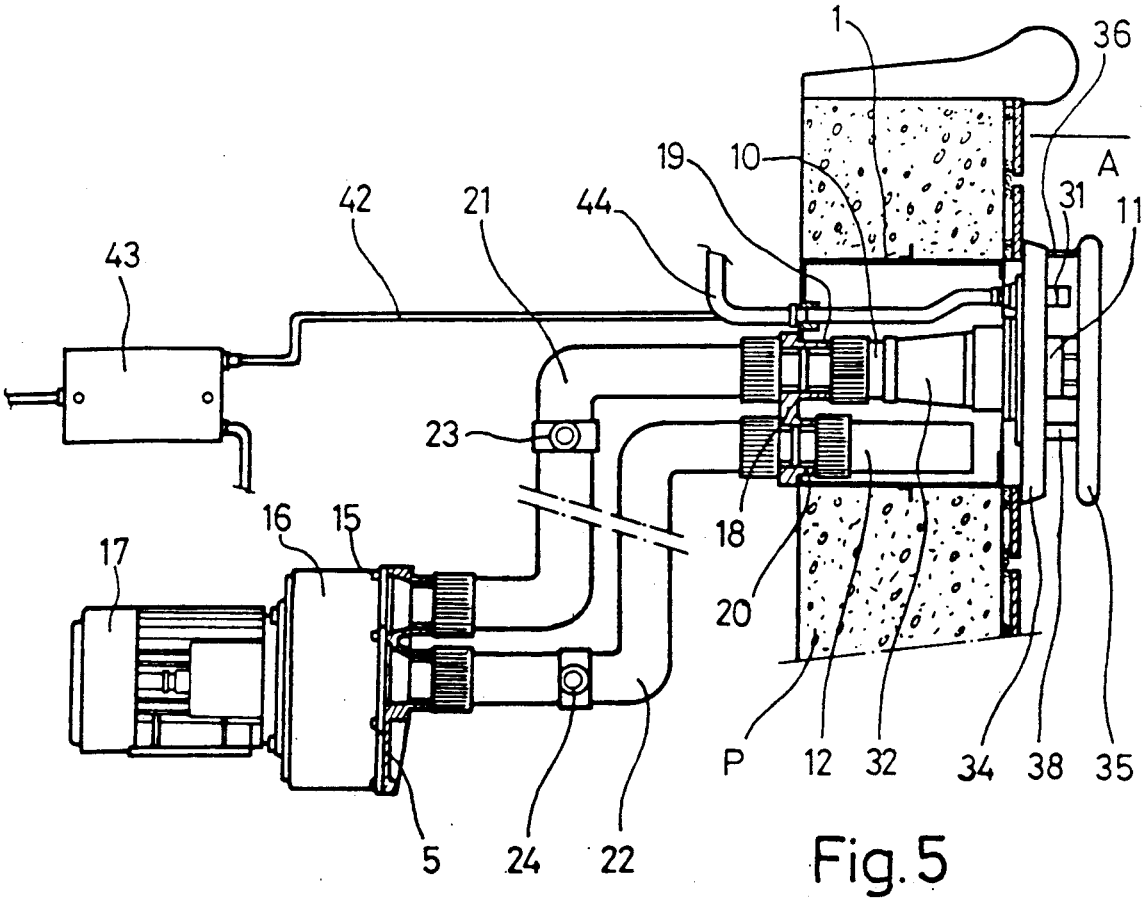

In the drawings:

FIG. 1, is a section view in elevation of the assembly of the installation without the pump, FIG. 2 is a plan view in cross section of the front portion of the installation, FIG. 3 is a view on a smaller scale of the front portion of the installation, and FIGS. 4 and 5 are schematic views of the assembly of the installation, in the compact version (with the face plate and handgrip separated) and in the remote pump version, respectively.

According to the drawings, the countercurrent installation comprises a main metal housing 1 built into the wall P of the swimming pool, the rear face 2 of which is provided with two openings 3 in which there is attached by way of bolts 4 a plate 5 having two perforations 6 and 7 which extend towards the front forming respective tapped tubular stubs 8 and 9 and to which there are respectively coupled the water discharge tube 10 which is coupled to the corresponding discharge orifice 11, and the suction tube 12 for the water A from the swimming pool, the front port 13 of which is close to the front surface 14 of the main housing 1.

The plate 5 is provided on the periphery thereof with orifices for coupling the pump 16 forming a block with the corresponding motor 17 (FIG. 4), on the rear face thereof by way of bolts 15, thereby determining compact assembly of the installation.

For when the pump and the motor thereof are to be connected remotely to the main housing 1, then a second smaller plate 18 (FIG. 5) has been contemplated which is attached by bolts to the rear openings of said housing, instead of the plate 5, and which is also provided with two perforations extending to form the corresponding tubular threaded stubs 19 and 20 for respective coupling of the discharge tube and the suction tube.

To the rear of the said tubular stubs 19 and 20 there will be connected the corresponding pipes 21 and 22 which will be connected at the rear end thereof to the tubular stubs 8 and 9 of the plate 5 which in this case is also attached to the pump 16. The pertinent valves 23 and 24 will be disposed in the pipes 21 and 22 for closing them when it is of interest to shut off the water flow, for example to disconnect the pump for maintenance or replacement.

A very strong metal base plate 27 having two wing formations 28 at the sides folded backwards and abutting the swimming pool wall P with the intermediary of seals 29 is attached by studs 26 (FIG. 2) to the front surface of the main housing 1 in which there is provided the corresponding opening 25. Attached to the base plate is the air switch 30 for starting and stopping the installation and the air control 31, as well as the discharge orifice 11 resiliently supported by the sleeve 32 snugly fitted on the discharge tube 10.

An independent face plate 34 formed by a sheet of light- weight material such as stainless steel is attached to the front of the base plate 27 by screws 33 (FIG. 2) and is provided with the pertinent openings for access to the controls 30 and 31 and to the discharge orifice 11.

A handgrip 35 formed by a closed tube constituting a rectangular fence having rounded corners and no projecting portions may be attached to said base plate 27. The handgrip surrounds the front of the face plate 34 and allows the user to take hold in any position.

The handgrip 35 is removably attached by way of three flat bars 36, 37 and 38 welded to the rear portion thereof and which pass through the face plate 34 through slots 39 provided in the edge thereof and are attached by bolts 40 to an upper appendage 41 of the base plate 27 and at lower lateral portions thereof.

The reference numeral 42 denotes the connection pipe of the air controller 30 to the box 43 of the electrical equipment for starting and stopping the pump drive motor 17 and reference numeral 44 denotes the connection pipe of the control 31 with the air connection for the Venturi effect in the discharge orifice 11 through the connection 45 to the sleeve 32.

I CLAIM:

1. A countercurrent installation for swimming pools, of a type comprising a main housing built into a swimming pool wall and provided with a face plate having controls and a discharge orifice for water mixed with air, and with a handgrip, in said housing water is suctioned and discharged by means connected to a pump, characterized in that the main housing is provided on the rear surface thereof with two openings (3) to which there is removably attached a plate (5) which extends frontally forming two tubular stubs (8 and 9) on which there are threadedly mounted tubes corresponding, respectively, to connection (10) with the discharge orifice (11) and the direct suction (12) of the water (A) from the swimming pool.

2. A countercurrent installation for swimming pools, according to claim 1, characterized in that the face plate is formed by a plate (34) which is supported by a front base plate (27) attached between the face plate (34) and the front surface (14) of the main housing (1), to said base plate (27) there is also removably attached the handgrip (35).

3. A countercurrent installation for swimming pools, according to claim 2, characterized in that the handgrip (35) is formed by a closed member forming a fence frontally surrounding the face plate (34).

4. A countercurrent installation for swimming pools, according to claim 2, characterized in that the handgrip (35) is attached to the front base plate (27) by flat bars (36, 37 and 38) extending from the rear thereof, which pass through (39) the edge of the face plate (34) and are attached (40) to points on the periphery of the front base plate (27).

* * * * *